US010441998B2

(12) United States Patent
Masuta et al.

(10) Patent No.: US 10,441,998 B2
(45) Date of Patent: Oct. 15, 2019

(54) CASTING METHOD AND CASTING DEVICE

(71) Applicant: NISSAN MOTOR CO., LTD., Yokohama-shi, Kanagawa (JP)

(72) Inventors: Tatsuya Masuta, Kanagawa (JP); Shunsuke Ota, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 189 days.

(21) Appl. No.: 15/129,204

(22) PCT Filed: Mar. 4, 2015

(86) PCT No.: PCT/JP2015/056353
§ 371 (c)(1),
(2) Date: Sep. 26, 2016

(87) PCT Pub. No.: WO2015/151701
PCT Pub. Date: Oct. 8, 2015

(65) Prior Publication Data

US 2018/0178276 A1 Jun. 28, 2018

(30) Foreign Application Priority Data

Mar. 31, 2014 (JP) ..... 2014-070842

(51) Int. Cl.
*B22D 18/04* (2006.01)
*B22D 18/08* (2006.01)

(52) U.S. Cl.
CPC ..... *B22D 18/04* (2013.01); *B22D 18/08* (2013.01)

(58) Field of Classification Search
CPC ..... B22D 18/04; B22D 18/08
(Continued)

(56) References Cited

U.S. PATENT DOCUMENTS 4,585,050 A * 4/1986 Merrien et al. ..... B22D 18/08 164/119
4,763,717 A * 8/1988 Lajoye ..... B22D 13/04 164/258

(Continued)

FOREIGN PATENT DOCUMENTS

CN 1960822 A 5/2007
JP 50-143726 A 11/1975

(Continued)

OTHER PUBLICATIONS

J. Jorstad et al., Pressure Assisted Processes for High Integrity Aluminum Castings—Part I, Foundry Trade Journal International, Institute of Cast Metals Engineers, vol. 183, No. 3668, Oct. 1, 2009, pp. 250-254.

(Continued)

*Primary Examiner* — Kevin P Kerns
(74) *Attorney, Agent, or Firm* — Foley & Lardner LLP

(57) ABSTRACT

Molten metal M is raised to the vicinity of a gate 11 of a cavity 9C by increasing the pressure in a holding furnace 5 with gas, and thereafter the cavity 9C is filled with the molten metal M by decreasing the pressure in the cavity 9C by suction and further increasing the pressure in the holding furnace 5. Thereafter, the decompression of the cavity 9C is stopped after a preset filling time, and the compression of the holding furnace 5 is stopped when solidification of the molten metal M is completed. In this way, the suction is minimized, and it becomes possible to employ a simple decompression part 14. A reduction in equipment cost and production cost is thereby achieved, and a reduction in casting cycle time is also achieved.

9 Claims, 11 Drawing Sheets

(58) Field of Classification Search
USPC ... 164/457, 254, 255, 256, 257, 258, 61, 63, 164/65, 119, 306
See application file for complete search history.

(56) References Cited

U.S. PATENT DOCUMENTS

| | | | | |
|---|---|---|---|---|
| 5,423,369 | A * | 6/1995 | Ota et al. | B22D 18/06 164/119 |
| 5,427,170 | A * | 6/1995 | Arakawa et al. | B22D 18/06 164/119 |
| 5,454,416 | A * | 10/1995 | Ota et al. | B22D 18/06 164/254 |
| 5,597,032 | A * | 1/1997 | Merrien | B22D 18/08 164/155.2 |
| 5,937,931 | A | 8/1999 | Hässig | |
| 6,247,521 | B1 * | 6/2001 | Kawai et al. | B22D 18/04 164/119 |
| 6,422,294 | B1 | 7/2002 | Murata et al. | |
| 2007/0209771 | A1 | 9/2007 | Makino et al. | |
| 2016/0045955 | A1 | 2/2016 | Sasaki et al. | |

FOREIGN PATENT DOCUMENTS

| | | | |
|---|---|---|---|
| JP | 58-23562 | A | 2/1983 |
| JP | 59-144564 | A | 8/1984 |
| JP | 62-114761 | A | 5/1987 |
| JP | 1-80769 | U | 5/1989 |
| JP | 01-180769 | A | 7/1989 |
| JP | 06-114533 | A | 4/1994 |
| JP | 2933255 | B2 | 8/1999 |
| JP | 2014-180696 | A | 9/2014 |
| KR | 10-0704074 | B1 | 3/2007 |

OTHER PUBLICATIONS

English translation of JP 50-143726, Nov. 19, 1975, 8 pages.

* cited by examiner

CASTING METHOD AND CASTING DEVICE

TECHNICAL FIELD

The present invention relates to a casting method and a casting device for molding a product based on low-pressure casting.

BACKGROUND ART

For example, a casting method and a casting device of this type are described in Patent Document 1. The casting method (and the casting device) of Patent Document 1 involves providing a sealed chamber that encloses a mold, decreasing the pressure in the sealed chamber and a stalk by means of suction by using a vacuum pump and a vacuum tank, and then immediately filling a cavity with molten metal by increasing the pressure in a holding furnace. In this way, the casting speed of the molten metal is increased, and the molten metal run is improved.

CITATION LIST

Patent Literature

Patent Document 1: Japanese Patent No. 2933255

SUMMARY OF INVENTION

Technical Problem

However, a problem with such conventional casting methods (and casting devices) is high equipment cost and high production cost since a decompression device with high evacuation capacity is required in order to decrease the pressure in the sealed chamber, the cavity of the mold therein and the stalk at the same time. Further, another problem is difficulty in reducing the casting cycle time since it takes a certain time to decrease the pressure in the vacuum tank to a certain reduced level. Therefore, it has been required to solve these problems.

The present invention has been made in view of the above-described problems with the prior art, and an object thereof is to provide a casting method and a casting device that perform minimum suction and thus can have reduced equipment cost and reduced production cost and can also have reduced casting cycle time.

Solution to Problem

The casting method according to the present invention for molding a product based on low-pressure casting by using a casting device, in which a mold with a cavity is disposed over a holding furnace storing molten metal, involves the step of: raising the molten metal to the vicinity of a gate of the cavity by increasing the pressure in the holding furnace with gas and thereafter filling the cavity with the molten metal by decreasing the pressure in the cavity by suction and further increasing the pressure in the holding furnace. This configuration serves as means for solving the problem with the prior art.

The casting device according to the present invention includes: a plurality of casting units each including a holding furnace configured to store molten metal, a mold with a cavity and a compression part to increase a pressure in the holding furnace with gas; and a decompression part to decrease a pressure in cavities of the plurality of casting units. The decompression part includes a vacuum tank with a suction pipe at an inlet side and a discharge pipe at an outlet side, a vacuum pump connected to the discharge pipe of the vacuum tank, branch pipes that are branched from the suction pipe of the vacuum tank and are respectively communicated with the cavity of each of the plurality of casting units and on-off valves configured to open and close the respective branch pipes.

Advantageous Effects of Invention

In the casting method and the casting device of the present invention, the suction is minimized. Therefore, a reduction in equipment cost and production cost can be achieved by employing a simple decompression part, and a reduction in casting cycle time can also be achieved.

DESCRIPTION OF EMBODIMENTS

First Embodiment

Figure 1:
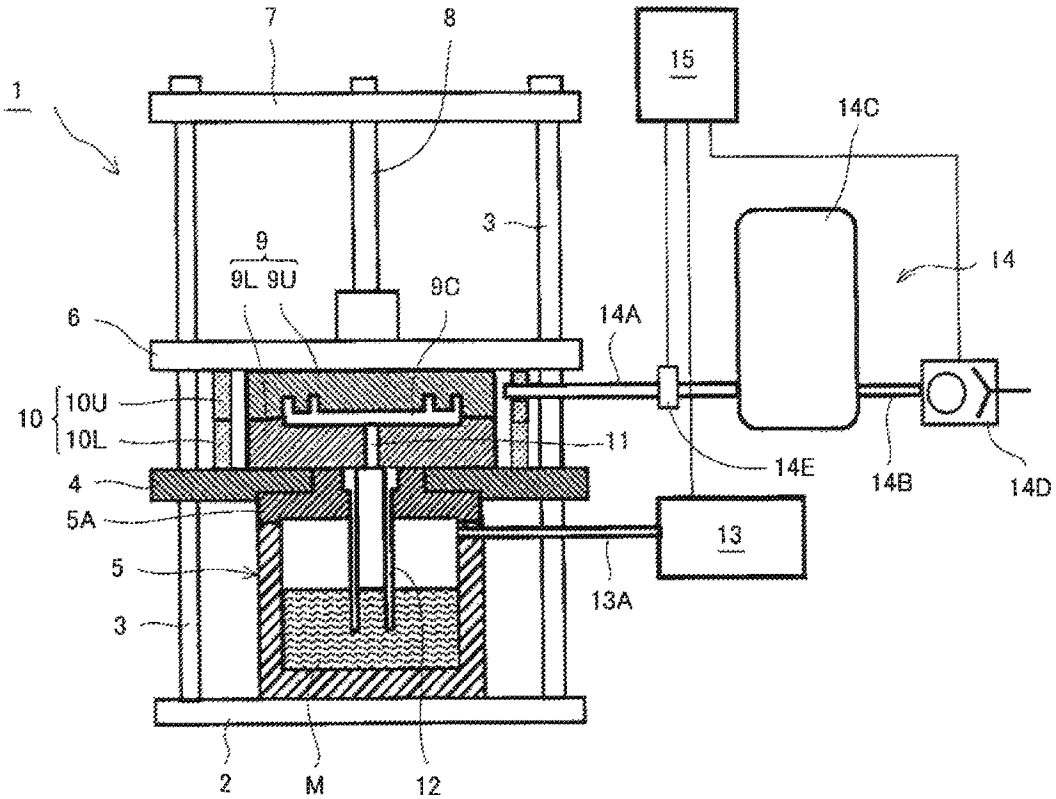
FIG. 1 is an explanatory cross sectional view of a casting device according to a first embodiment of the present invention.

A casting device 1 of FIG. 1 includes a base 2, a plurality of guide posts 3 standing on the base 2, a fixed table 4 fixed in the middle of the guide posts 3 and a holding furnace 5 disposed between the fixed table 4 and the base 2. Further, the casting device 1 includes a movable table 6 configured to move up and down along the guide posts 3 and a frame 7 disposed across the upper end parts of the guide posts 3. Between the frame 7 and the movable table 6, a hydraulic cylinder 8 is provided to move the movable table 6 up and down.

The casting device further includes a mold 9 between the movable table 6 and the fixed table 4 and a chamber 10 in which the mold 9 is air-tightly housed. The mold 9 includes an upper mold 9U fixed to the movable table 6 and a lower mold 9L fixed to the fixed table 4. They form a cavity 9C as a casting space between them. Further, a gate 11 is provided in the lower mold 9L, which is open to the lower part of the cavity 9C.

The chamber 10 includes an upper frame 10U that surrounds the upper mold 9U on the movable table 6 and a lower frame 10L that surrounds the lower mold 9L on the fixed table 4. They form a hermetically sealed space between them when the mold is closed.

The holding furnace 5, which stores molten metal M, includes a lid 5A that is attached to the lower side of the fixed table 4, a heating part (not shown) and the like. The lid 5A has a stalk 12 for supplying the molten metal M to the cavity 9C. The upper end of the stalk 12 is communicated with the gate 11 of the mold 9, and the lower end is dipped in the molten metal M.

The casting device 1 further includes a compression part 13 to increase the pressure in the holding furnace 5 with gas, a decompression part 14 to decrease the pressure in the cavity 9C of the mold 9 by suction and a control part 15 to control them.

Although not shown in detail in the figure, the compression part 13 includes a tank for storing pressurizing gas such as inert gas, an on-off valve, a pipe and the like. The compression part 13 compresses and supplies the pressurizing gas to the holding furnace 5 through a supply pipe 13A so as to apply a pressure to the surface of the molten metal M. As a result, the molten metal M fills the cavity 9C through the stalk 12.

The decompression part 14 includes a vacuum tank 14C with a suction pipe 14A at the inlet side and a discharge pipe 14B at the outlet side, a vacuum pump 14D connected to the discharge pipe 14B of the vacuum tank 14C and an on-off valve 14E configured to open and close the suction pipe 14A. The decompression part 14 of this embodiment includes the suction pipe 14A that penetrates the upper frame 10U of the chamber 10. The decompression part 14 suctions the gas in the chamber 10 so as to decrease the pressure in the cavity 9C of the mold 9 by the suction. The vacuum tank 14C of the decompression part 14 has a volume sufficiently larger than the total volume of the inner space of the chamber 10 (excluding the space occupied by the mold 9) and the cavity 9C.

The control part 15 controls the operation of the compression part 13 as well as the vacuum pump 14D and the on-off valve 14E of the decompression part 14. The control part 15 also controls the operation of the hydraulic cylinder 8 for moving the movable table 6 up and down, a driver of an ejector mechanism (not shown) for releasing a product, and the like.

Figure 2A:
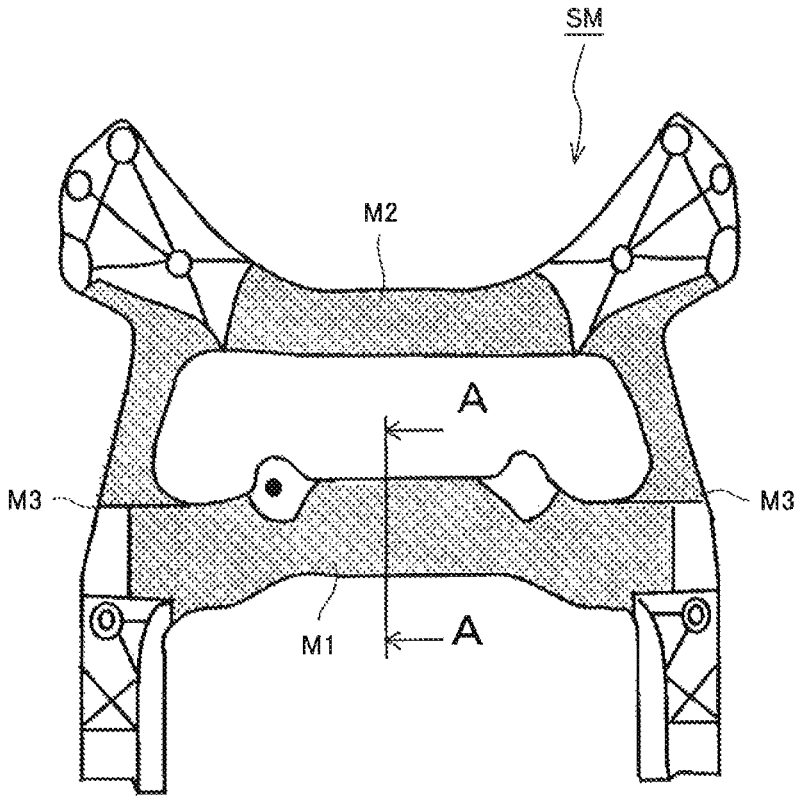
FIG. 2A is a plan view of a front suspension member of a car, which is an example of the product.
Figure 2B:
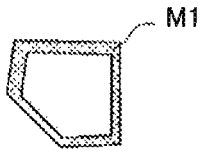
FIG. 2B is a cross sectional view of a hollow portion taken along the line A-A.

For example, the casting method and the casting device of the present invention can cast a front suspension member (hereinafter referred to as a "suspension member") SM of a car as illustrated in FIG. 2A and FIG. 2B. The suspension member SM is a frame member that couples the body with the axle of a car and is also used for mounting an engine. The suspension member SM of the illustrated example integrally includes a front cross member portion M1, a rear cross member portion M2 to be disposed at the body side, and left and right side member portions M3, M3. For example, the suspension member SM is made of an aluminum alloy.

The suspension member SM is configured such that the both cross members M1, M2 and the side members M3 have a hollow shape (closed-section structure) in the center portions of the both cross member M1, M2 as illustrated in FIG. 2B. The hollow portions are formed by using cores disposed in the cavity 9C. The suspension member SM has improved strength and light weight and is relatively thin-walled and large as a casting.

Next, a casting method of the present invention will be described along with the operation of the above-described casting device 1.

The casting method of the present invention is to mold a product by low-pressure casting by using the casting device 1 in which the mold 9 with the cavity 9C is disposed over the holding furnace 5 that stores the molten metal M. In the casting method, the molten metal M is raised to the vicinity of the gate 11 of the cavity 9C by increasing the pressure in the holding furnace 5 with gas. Thereafter, the cavity 9C is filled with the molten metal M by decreasing the pressure in the cavity 9C by suction and further increasing the pressure in the holding furnace 5. Then, the decompression of the cavity 9C is stopped after a preset filling time. When solidification of the molten metal M is completed, the compression of the holding furnace 5 is stopped.

Figure 3:
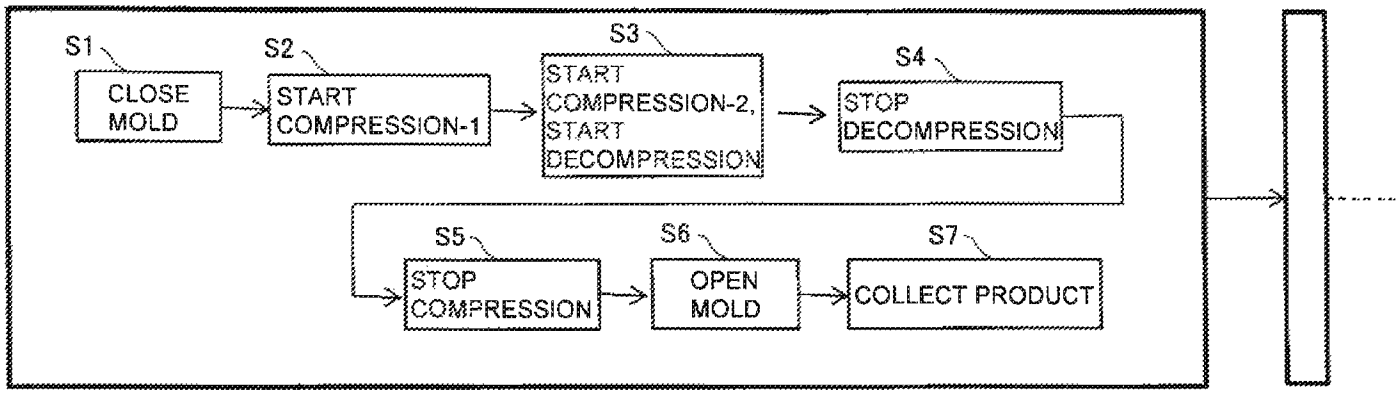
FIG. 3 is a block diagram illustrating the steps of the casting method of the present invention.
Figure 4:
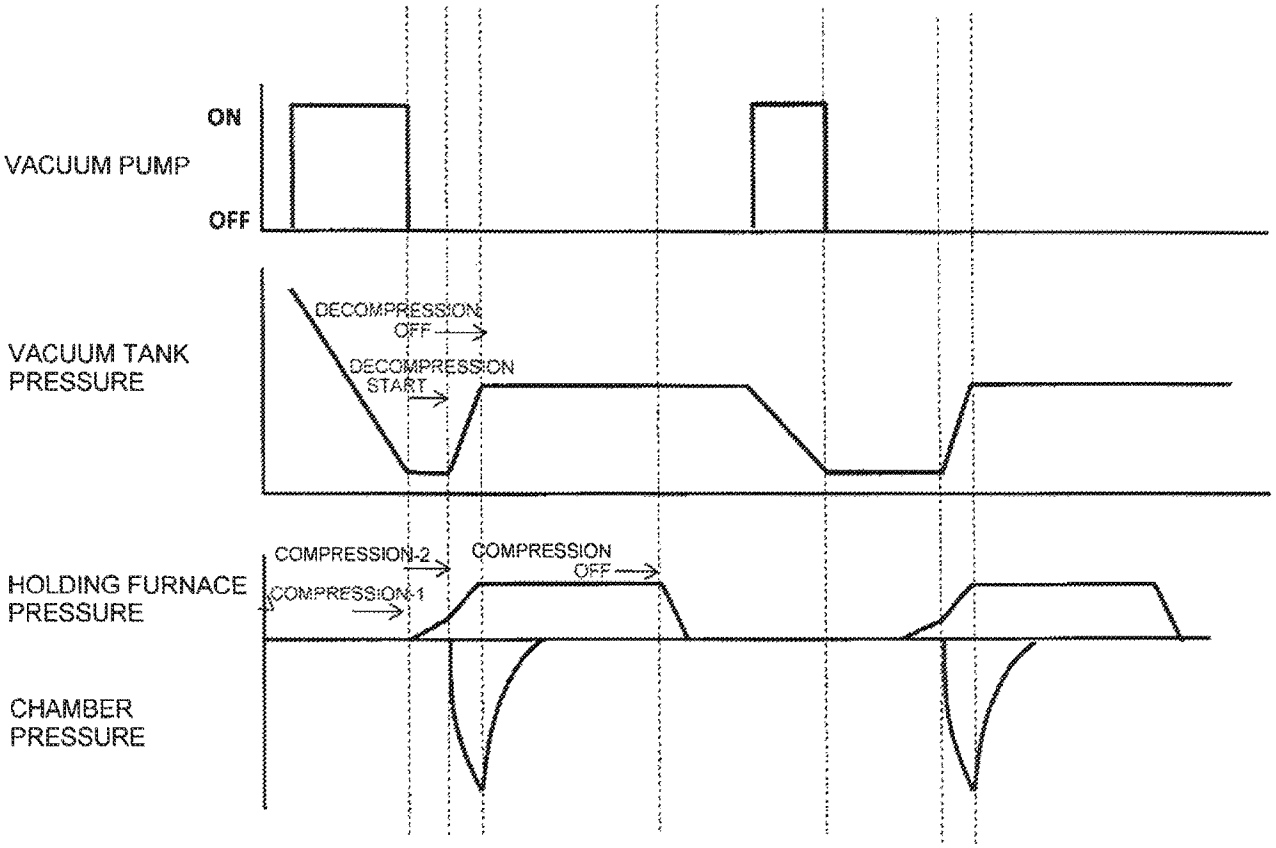
FIG. 4 is a timing chart of the operation of a vacuum pump, the pressure in a vacuum tank, the compression by the holding furnace and the pressure change in the chamber, which are the components illustrated in FIG. 1.

Specifically, the casting method starts with the first step (Step S1) of closing the mold as illustrated in FIG. 3. Step S1 involves moving down the movable table 6 to close the upper mold 9U and the lower mold 9L and also to close the upper frame 10U and the lower frame 10L so as to hermetically close the chamber 10. In this step, the decompression part 14 runs the vacuum pump 14D for a predetermined time as illustrated in FIG. 4 to suction the gas in the vacuum tank 14C so that the pressure in the vacuum tank 14C is maintained at a certain reduced level.

Then, the casting method continues with Step S2 where Compression 1 is started. Step S2 involves increasing the pressure in the holding furnace 5 with gas by the compression part 13 and thereby raising the molten metal M to the vicinity of the gate 11 of the cavity 9C. That is, Compression 1 in FIG. 4 is to apply such a pressure that raises the molten metal M to the vicinity of the gate 11 of the cavity 9C.

The casting method continues with Step S3 where Compression 2 is started, and a decompression is also started. Step S3 involves further increasing the pressure in the holding furnace 5 by the compression part 13 and decreasing the pressure in the cavity 9C by means of suction by the decompression part 14. That is, Compression 2 in FIG. 4 is to apply such a pressure that fills the cavity 9C with molten metal M. In this step, since the pressure in the vacuum tank 14C has been already decreased, the decompression part 14 opens the on-off valve 14E to cause rapid suction of the gas in the chamber 10, so as to rapidly decrease the pressure in the cavity 9C by the suction.

The casting method continues with Step S4 where the decompression is stopped after a predetermined filling time, and then Step S5 where the compression is stopped when solidification of the molten metal M is completed. The filling time and the solidification time of the molten metal M can be determined beforehand by an experiment or the like and can be set in a timer of the control part 15 as a control data for the decompression part 14 and the compression part 13. For example, to produce the suspension member SM of FIG. 2A and FIG. 2B, the filling time of the molten metal M ranges approximately from 2 to 4 seconds, and the solidification time of the molten metal M ranges approximately from 25 to 35 seconds. These times are suitably set according to the shape, size and the like of the product.

Step S4 involves stopping the decompression of the cavity 9C by closing the on-off valve 14E of the decompression part 14. Further, Step S5 involves stopping the compression of the holding furnace 5 by turning off the compression part 13.

Thereafter, the casting method continues with Step S6 where the mold is opened and then Step S7 where the product is taken out. That is, Step S6 involves moving up the upper mold 9U together with the movable table 6 so as to open the mold 9. Further, Step S7 involves releasing the product from the mold by means of the ejector mechanism (not shown) and taking it out by means of a suitable conveyance mechanism.

In the casting method and the casting device 1, the molten metal M is raised to the vicinity of the gate of the cavity 9C by increasing the pressure in the holding furnace 5, and thereafter the cavity 9C is filled with the molten metal M by decreasing the pressure in the cavity 9C and further increasing the pressure in the holding furnace 5. Therefore, the amount of suction by the decompression part 14 corresponds to the total volume of the inner space of the chamber 10 (excluding the space occupied by the mold 9) and the cavity 9C. That is, the decompression part 14 performs the minimum suction. Therefore, in the casting method and the casting device 1, a reduction in equipment cost and production cost can be achieved by employing a simple decompression part 14.

To be more specific, the amount of suction by the decompression part 14 can be reduced in the casting method and the casting device 1, which allows leaving a sufficient reserve in the vacuum tank 14C. That is, when the pressure in the cavity 9C is decreased in the first casting, the pressure in the vacuum tank 14C does not return to the atmospheric pressure but is maintained at a predetermined reduced level as illustrated in FIG. 4. Therefore, the pressure of the vacuum tank 14C can be recovered to the initial reduced level in a short decompression time (operation time of the vacuum pump 14D), when the next casting is made. This can reduce the casting cycle time of the casting method and the casting device 1.

In the casting method and the casting device 1, the molten metal M is raised to the vicinity of the gate 11, and thereafter the cavity 9C is filled with the molten metal M by rapidly decreasing the pressure in the cavity 9C and further increasing the pressure in the holding furnace 5. Therefore, the molten metal M runs in the cavity 9C very well, and it is possible to mold a relatively thin and large product such as the suspension member SM of FIG. 2A and FIG. 2B.

In particular, in the casting device 1, the cavity 9C of the mold 9 is a casting space for molding the suspension member SM of a car. Therefore, the above-described improvement in the molten metal run makes it possible to obtain the high quality suspension member SM.

In the casting method and the casting device 1, the decompression of the cavity 9C is stopped after a preset filling time. Therefore, when the suspension member SM with the hollow portions as illustrated in FIG. 2A and FIG. 2B is molded, it is possible to stop the decompression part 14 before gas is produced from the cores for forming the hollow portions. This can prevent the decompression part 14 from being contaminated by the gas (tar) from the cores.

FIG. 5 to FIG. 9 are explanatory views of the casting method and the casting device according to other embodiments according the present invention. In the following embodiments, the same reference signs are denoted to the same components as those of the first embodiment, and the description thereof is omitted.

Second Embodiment

Figure 5:
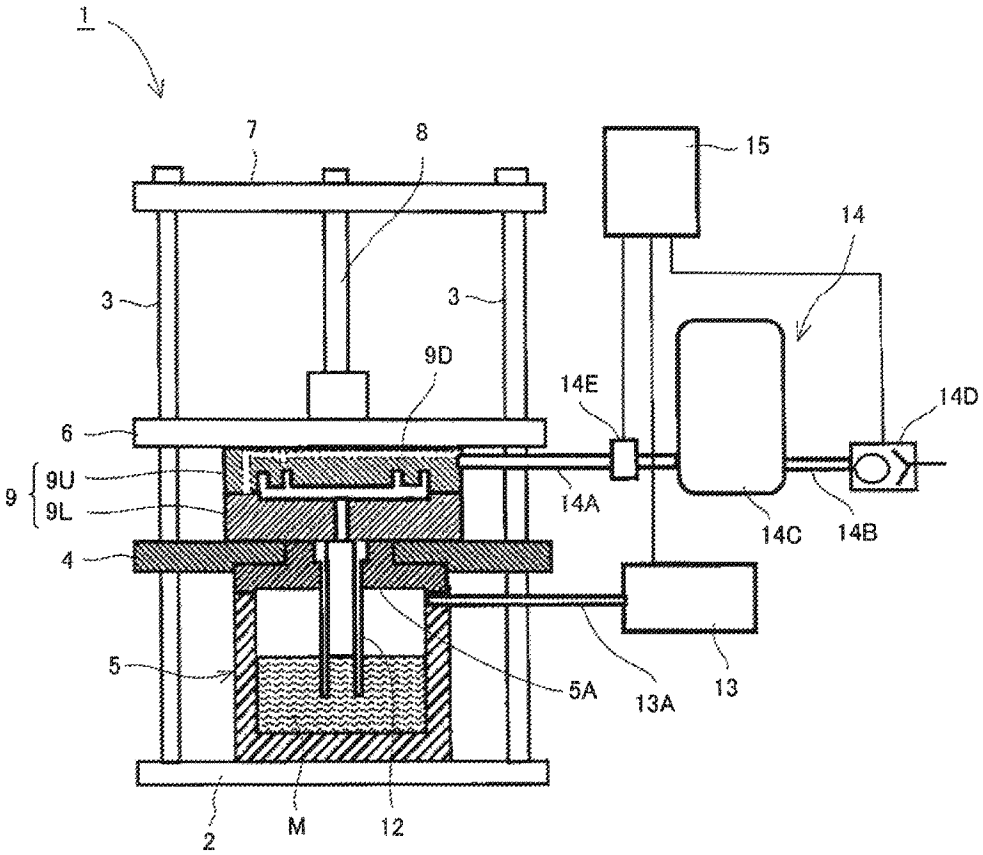
FIG. 5 is an explanatory cross sectional view of a casting device according to a second embodiment of the present invention.

A casting device 1 of FIG. 5 does not include a chamber (10) of the first embodiment but is configured such that a discharge path 9D for communicating a cavity 9C to the outside is formed in an upper mold 9U of a mold 9, and a suction pipe 14A of the decompression part 14 is connected to the discharge path 9D.

The casting device 1 has the same functions and advantageous effects as those of the first embodiment. Furthermore, the amount of suction by the decompression part 14 is further reduced, which can further decrease the decompression time of the vacuum tank 14C and the casting cycle time.

Third Embodiment

Figure 6:
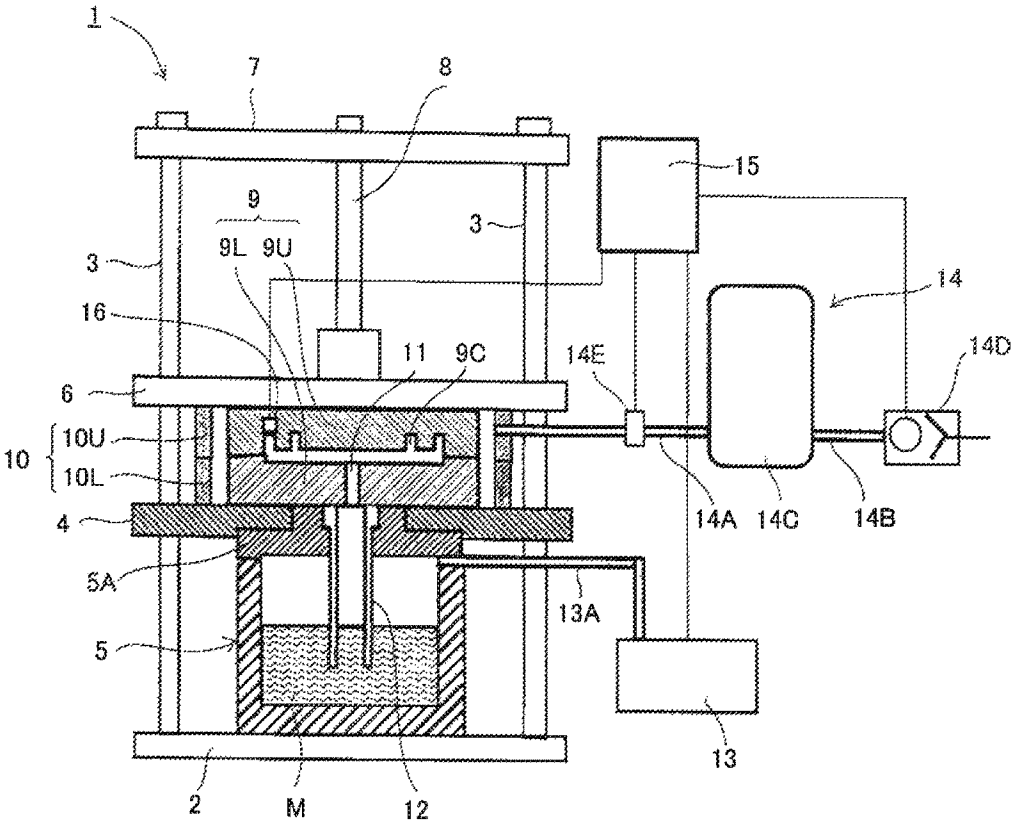
FIG. 6 is an explanatory cross sectional view of a casting device according to a third embodiment of the present invention.

A casting device 1 of FIG. 6 has the same basic configuration as that of the first embodiment. In addition, the casting device 1 further includes a molten metal sensor 16 that is disposed in an upper mold 9U of a mold 9 for detecting completion of filling a cavity 9C with the molten metal M. For example, the molten metal sensor 16 is constituted by a temperature sensor, which is disposed at the furthest location from a gate 11 and is configured to input a measured value to the control part 15. When the temperature measured by the molten metal sensor 16 exceeds a predetermined value, the control part 15 determines that the cavity 9C is completely filled with the molten metal M. Alternatively, the molten metal sensor 16 may be constituted by a sensor that conducts electricity while the molten metal M is in contact with the sensor.

As with the first embodiment, a casting method using the casting device 1 involves raising the molten metal M to the vicinity of the gate 11 of the cavity 9C by increasing the pressure in a holding furnace 5 with gas, and thereafter filling the cavity 9C with the molten metal M by decreasing the pressure in the cavity 9C by suction and further increasing the pressure in the holding furnace 5. The casting method further involves stopping the decompression of the cavity 9C when the molten metal sensor 16 detects completion of filling with the molten metal M within the preset filling time.

Figure 7:
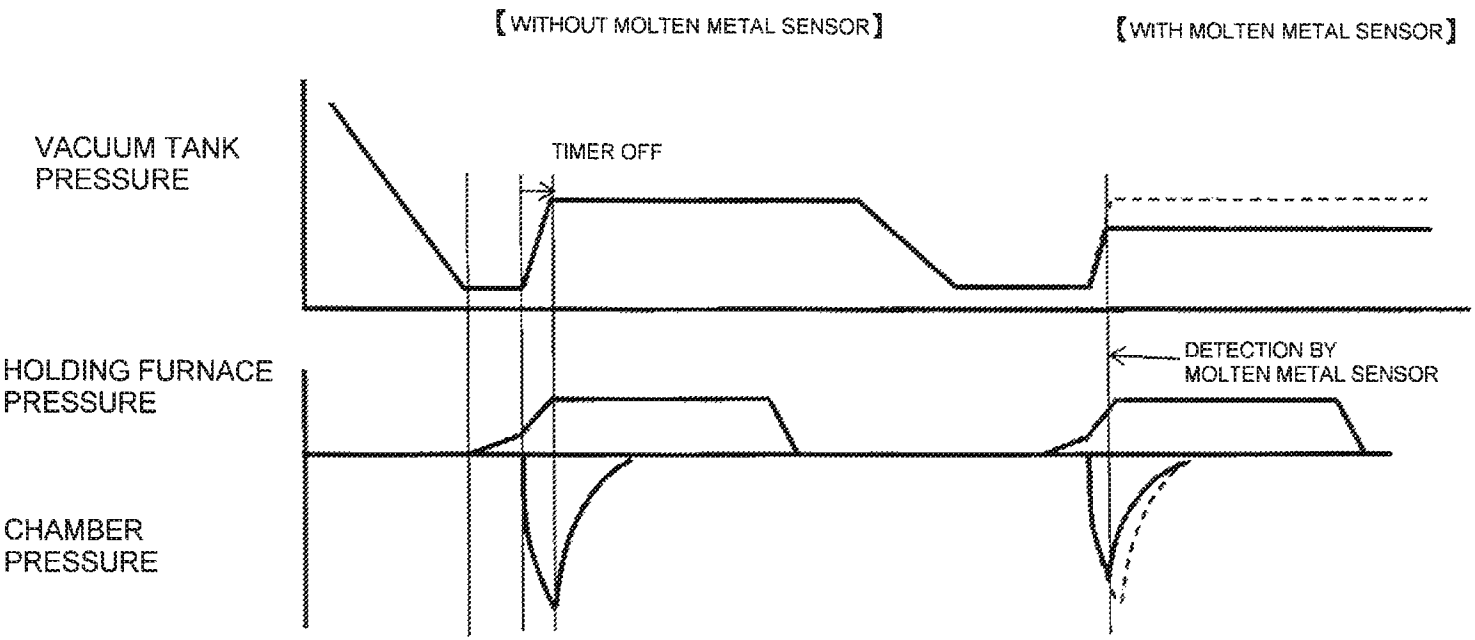
FIG. 7 is a timing chart of the pressure in the vacuum tank, the compression by the holding furnace and the pressure change in the chamber, which are the components illustrated in FIG. 6.

The casting method and the casting device 1 have the same functions and advantageous effects as those of the previously described embodiments. Furthermore, the decompression part 14 can be stopped earlier than the preset filling time. As a result, in the casting method and the casting device 1, the reduced pressure of the vacuum tank 14C is maintained at a lower level while the reduced pressure in the chamber 10 is maintained at a higher level compared to those of the first embodiment (with no sensor) as illustrated in FIG. 7.

This means that excessive suction is eliminated as much as possible. That is, maintaining the reduced pressure in the vacuum tank 14C at a lower level leads to a shorter decompression time (operation time of the vacuum pump) in the next cycle. Further, the reduced pressure in the chamber 10 is maintained at a higher level because no excessive decompression is performed after the pressure in the chamber 10 is sufficiently decreased. As a result, a reduction in decompression time and casting cycle time is achieved in the casting method and the casting device 1.

Fourth Embodiment

Figure 8:
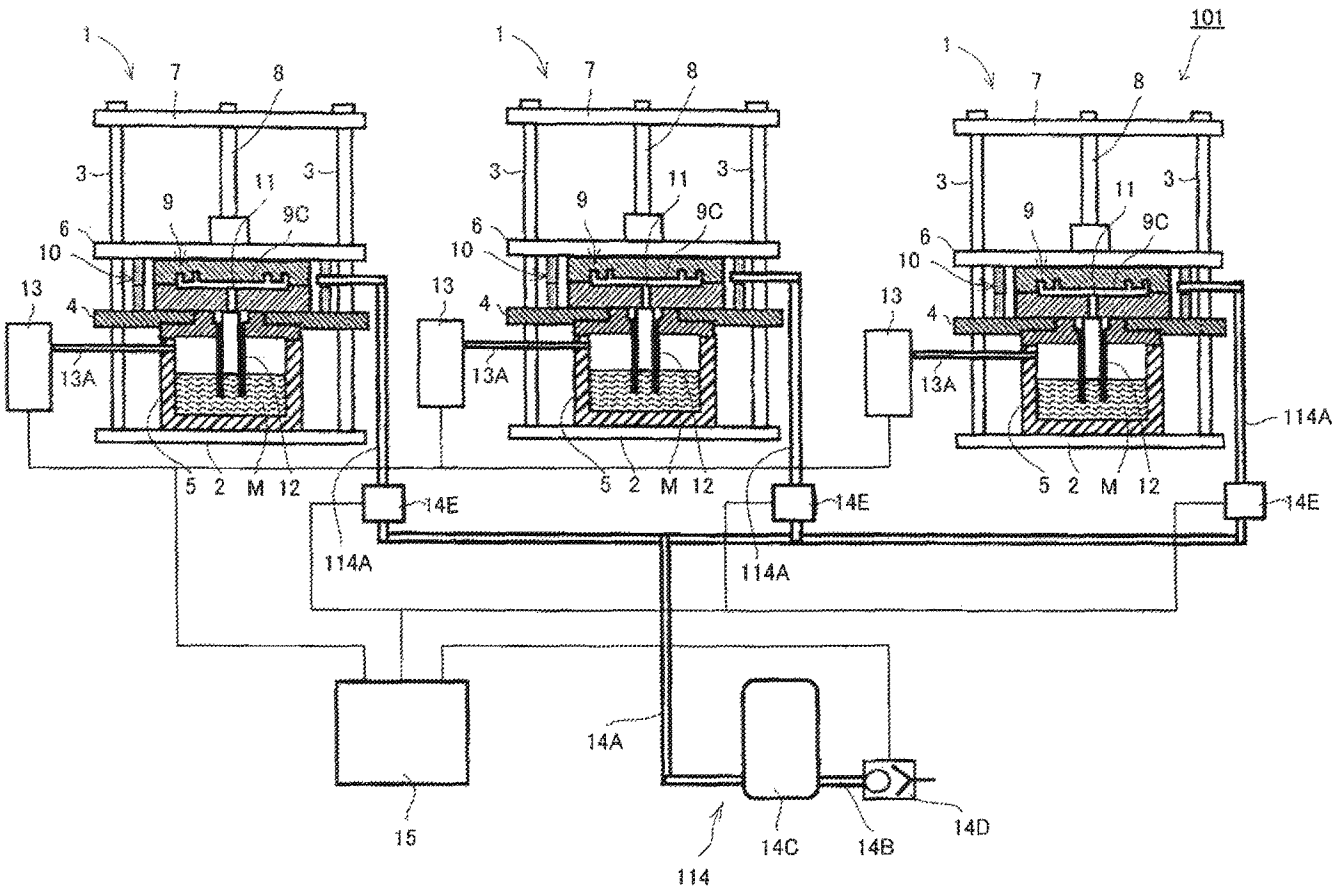
FIG. 8 is an explanatory cross sectional view of a casting device according to a fourth embodiment of the present invention.

A casting device 101 of FIG. 8 includes a plurality of casting units 1 (three casting units 1 in the illustrated example) each of which includes a holding furnace 5 that stores molten metal M, a mold 9 with a cavity 9C and a compression part 13 to increase the pressure in the holding furnace 5 with gas. Each of the casting units 1 has the same basic configuration as the casting devices 1 of the first to third embodiments. The casting device 101 further includes a decompression part 114 to decrease the pressure in the cavity 9C of each of the casting units 1 by suction and a control part 15 to control the compression part 13 and the decompression part 114.

The decompression part 114 includes a vacuum tank 14C with a suction pipe 14A in the inlet side and a discharge pipe 14B in the outlet side and a vacuum pump 14D connected to the discharge pipe 14B of the vacuum tank 14C. The decompression part 114 further includes branch pipes 114A that are branched off from the suction pipe 14A of the vacuum tank 14C and are in communication with the cavity 9C of each of the respective casting units 1 and on-off valves 14E that open and close the respective branch pipes 114A. In the illustrated example, the branch pipes 114A are connected to chambers 10 and are in communication with the cavities 9C via the chambers 10.

The control part 15 controls the operation of the compression part 13 of each of the casting units 1, the vacuum pumps 14D of the decompression part 114 and the on-off valves 14E.

Figure 9:
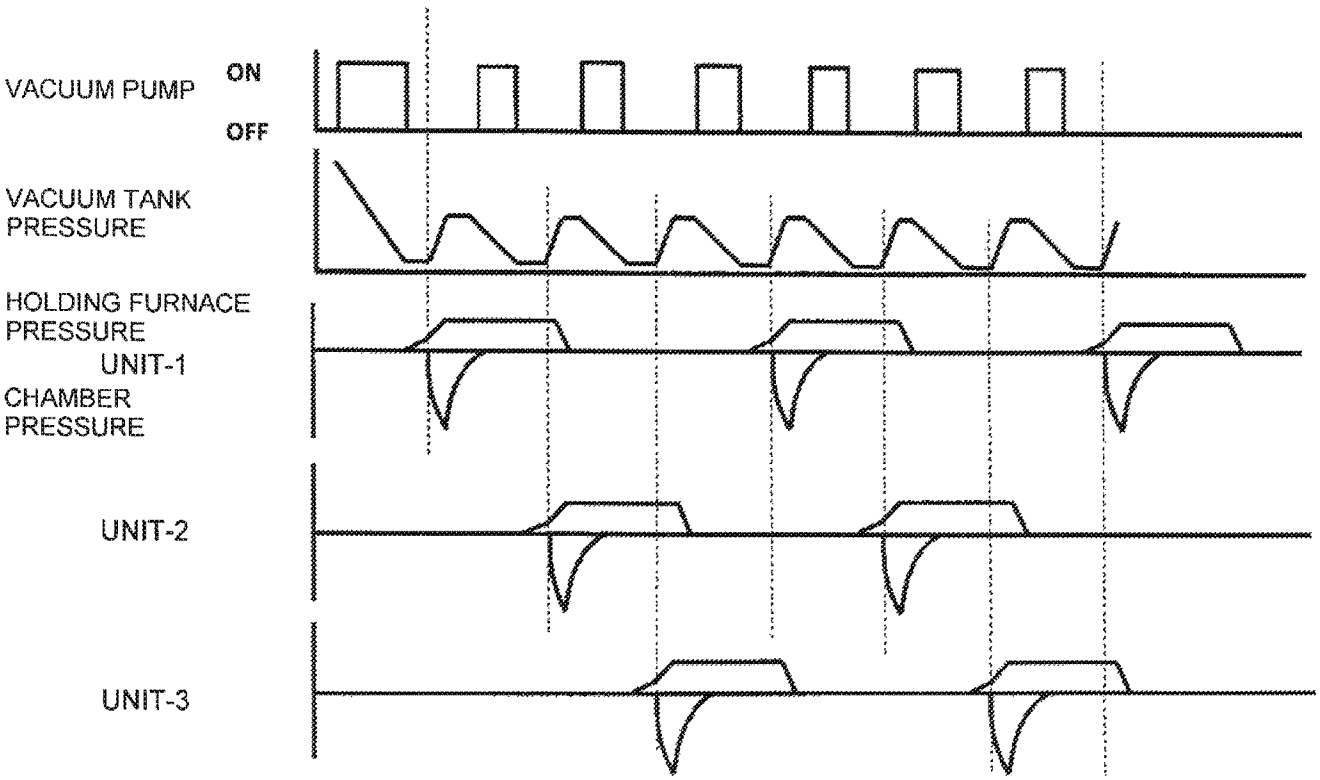
FIG. 9 is a timing chart of the operation of the vacuum pump, the pressure in the vacuum tank, the compression by the holding furnace of each casting unit and the pressure change in the chamber, which are the components illustrated in FIG. 8.

In the casting device 101, products are molded in each of the casting units 1 by the casting method as described in the first and third embodiments. As illustrated in FIG. 9, this process starts with decreasing the pressure of the vacuum tank 14C to an initial reduced level by means of suction by the vacuum pump 14D and thereafter casting a product in a first casting unit 1 (Unit 1).

That is, in the casting unit 1 (Unit 1) shown on the left side of FIG. 8, the molten metal M is raised to the vicinity of the gate 11 of the cavity 9C by increasing the pressure in the holding furnace 5 with gas by the compression part 13. Then, the cavity 9C is filled with the molten metal M by opening the on-off valve 14E of the decompression part 114 so as to rapidly decrease the pressure in the cavity 9C by suction and further increasing the pressure in the holding furnace 5 by the compression part 13. After a preset predetermined filling time, the decompression of the cavity 9C is stopped by closing the on-off valve 14E of the decompression part 14. When solidification of the molten metal M is completed, the compression of the holding furnace 5 by the compression part 13 is stopped.

Further, in the casting device 101, the pressure in the vacuum tank 14C is returned to the initial reduced level by running the vacuum pump 14D. As with the previously-described embodiments, the casting device 101 can return the pressure to the initial reduced level in a short decompression time (operation time of the vacuum pump 14D).

Then, the casting device 101 performs the same casting in the center casting unit 1 (Unit 2) in FIG. 8 and thereafter performs the same casting in the right casting unit 1 (Unit 3) in FIG. 8. The casting device 101 repeats the casting in this order.

In this way, a reduction in decompression time and casting cycle time can be achieved in each casting unit 1 of the casting device 101 and the casting method. Accordingly, continuous casting by using the plurality of casting units 1 can be performed efficiently. Further, the common decompression part 114 is shared in the casting device 101. This can reduce the installation area to a great extent. Further, a reduction in equipment cost and production cost can be achieved, and the maintenance can also be facilitated.

Fifth Embodiment

Figure 10A:
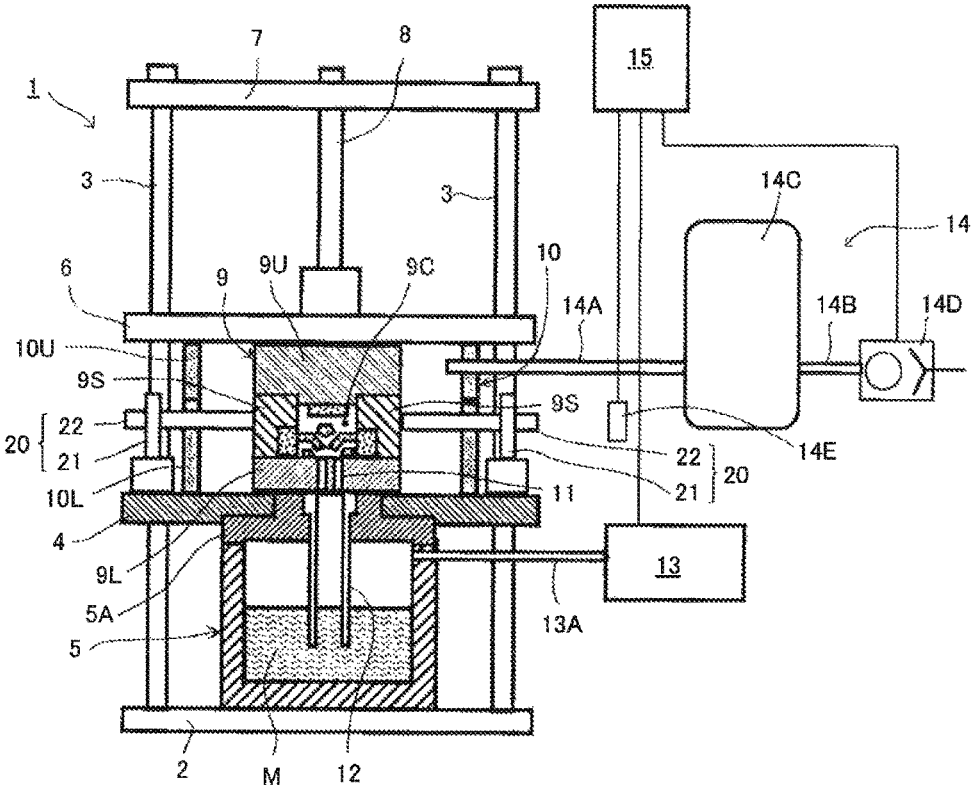
FIG. 10A is an explanatory cross sectional view of a casting device according to a fifth embodiment of the present invention.

A casting device 1 of FIG. 10A has the same basic configuration as that of the first embodiment, and the cavity 9C of a mold 9 is a casting space for molding a cylinder head of an internal combustion engine.

The mold 9 of this embodiment includes a plurality of divided side molds (slide cores) 9S between an upper mold 9U and a lower mold 9L, and the cavity 9C for a cylinder head is formed between them. Each of the side molds 9S is retractable relative to the center of the mold by means of respective drivers 20 disposed outside a chamber 10.

Each of the drivers 20 includes a cylinder 21 and a driving rod (cylinder rod) 22 that is reciprocated in the horizontal direction by the cylinder 21. The driving rods 22 slidably penetrate a lower frame 10L of the chamber 10 and are coupled to the side molds 9S. The portions of the chamber 10 that are penetrated by the driving rods 22 have a sealing structure for ensuring the air tightness of the chamber 10. The chamber 10 of this embodiment has a space between the mold 9 and the chamber 10 for retracting the side molds 9.

Figure 10B:
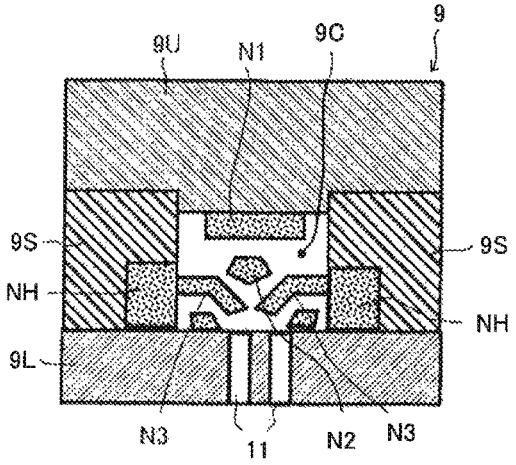
FIG. 10B is an enlarged cross sectional view of a mold.

Inside the cavity 9C, a core N1 for forming an upper recess, a core N2 for forming a water jacket and a plurality of cores N3 for forming ports of the cylinder head are disposed as illustrated in FIG. 10B. The cores N3 for forming the ports are integrated with a core print NH that is positioned between the side molds 9S and the lower mold 9L.

The casting device 1 having the above-described configuration is operated based on the previously-described casting method in which the molten metal M is raised to the vicinity of a gate by increasing the pressure in a holding furnace 5, and thereafter the cavity 9C is filled with the molten metal M by decreasing the pressure in the cavity 9C and further increasing the pressure in the holding furnace 5.

In the casting device 1, this allows employing a simple decompression part 14 as with the previously-described embodiments. A reduction in equipment cost and production cost is thereby achieved. Further, a reduction in casting cycle is also achieved. Furthermore, the casting device 1 is configured such that the decompression of the cavity 9C is stopped after a present filling time. That is, the decompression part 14 is turned off before gas is produced from the cores N1 to N3. This can prevent decompression part 14 from being contaminated by gas from the cores N1 to N3.

Furthermore, the casting device 1 is configured such that after the molten metal M is raised to the vicinity of the gate 11, the cavity 9C is filled with the molten metal M by the rapidly decreasing the pressure in the cavity 9C and further increasing the pressure in the holding furnace 5. Therefore, the molten metal M can run in the cavity 9C very well. In particular, the casting device 1 includes the mold 9 with the cavity 9C that is a casting space for molding a cylinder head of an internal combustion engine. Therefore, the above-described improvement in the molten metal run allows obtaining a high quality cylinder head.

Sixth Embodiment

Figure 11A:
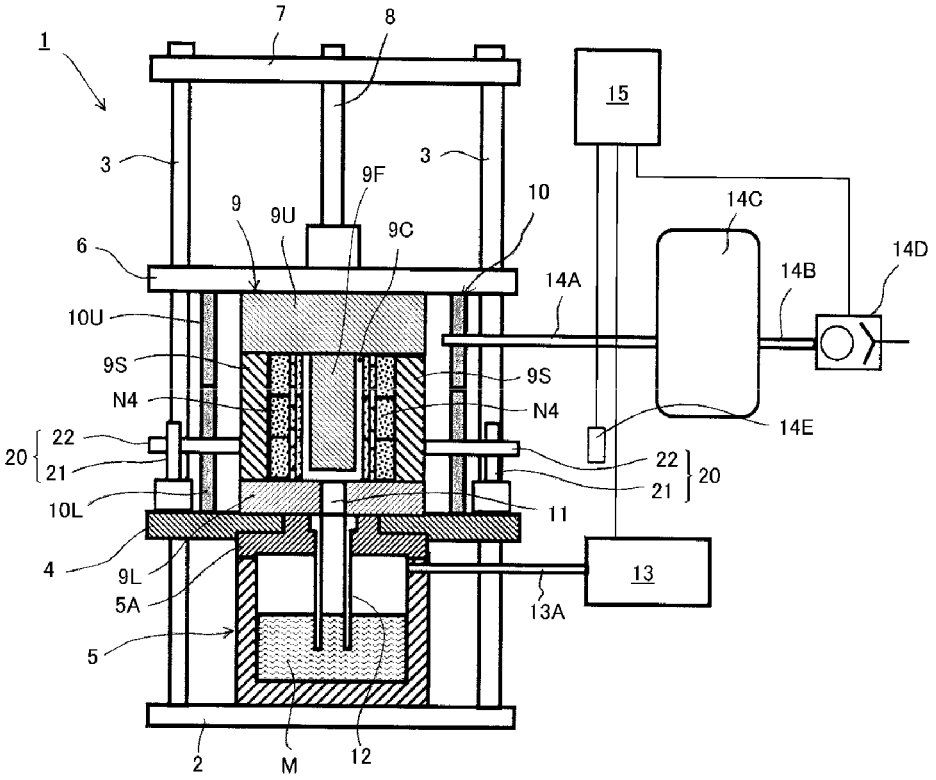
FIG. 11A is an explanatory cross sectional view of a casting device according to a sixth embodiment of the present invention.

A casting device 1 of FIG. 11A has the same basic configuration as that of the fifth embodiment, and the cavity 9C of a mold 9 is a casting space for molding a motor case.

The mold 9 of this embodiment includes an upper mold 9U, a lower mold 9L and a side mold 9S, and the cavity 9C for a motor case is formed between them. The side mold 9S is retractable relative to the center of the mold by means of a driver 20 composed of a cylinder 21 and a driving rod 22.

Figure 11B:
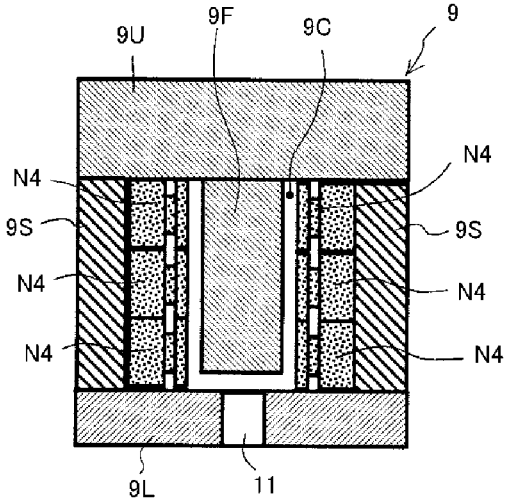
FIG. 11B is an enlarged cross sectional view of a mold.

Inside the cavity 9C, a plurality of cores N4 are disposed for forming water jackets as illustrated in FIG. 11B. The mold 9 of this embodiment integrally includes a space forming portion 9F for forming the inner space of the motor case. The space forming portion 9F hangs down from the center of the underface of the upper mold 9U so as to form the cavity 9C between the space forming portion 9F and the cores N4, which is a casting space for molding a thin motor case.

The casting device 1 having the above-described configuration is operated based on the above-described casting method such that molten metal M is raised to the vicinity of a gate of the cavity 9C by increasing the pressure in the holding furnace 5, and thereafter the cavity 9C is filled with the molten metal M by decreasing the pressure in the cavity 9C and further increasing the pressure in the holding furnace 5.

In the casting device 1, this allows employing a simple decompression part 14 as with the previously-described embodiments. A reduction in equipment cost and production cost is thereby achieved. Further, a reduction in casting cycle time is also achieved. Further, the casting device 1 is configured such that the decompression of the cavity 9C is stopped after a preset filling time. That is, the decompression part 14 is turned off before gas is produced from the cores N4. This can prevent the decompression part 14 from being contaminated by the gas from the cores N4.

Furthermore, the casting device 1 is configured such that after the molten metal M is raised to the vicinity of the gate 11, the cavity 9C is filled with the molten metal M by rapidly decreasing the pressure in the cavity 9C and further increasing the pressure in the holding furnace 5. Therefore, the molten metal M can run in the cavity 9C very well. In particular, in the casting device 1, the cavity 9C of the mold 9 is a casting space for molding a motor case, the above-described improvement of the molten metal run allows obtaining the high quality motor case.

The configuration of the casting method and the casting device of the present invention is not limited to the above-described embodiments, and they are applicable to production of parts having a complicated structure such as suspension members, cylinder heads and motor cases. Further, the compression part is not limited to a device that pressurizes molten metal with gas but may be constituted by a device that pushes out molten metal by an electric power such as an electromagnetic pump. The details of the configuration can be suitably changed without departing from the gist of the present invention.

REFERENCE SIGNS LIST

1 Casting device (casting unit)
5 Holding furnace
9 Mold
9C Cavity
11 Gate
16 Molten metal sensor
13 Compression part
14 Decompression part
14A Suction pipe
14B Discharge pipe
14C Vacuum tank
14D Vacuum pump
14E On-off valve
101 Casting device
114 Decompression part
114A Branch pipe
M Molten metal

The invention claimed is:

1. A casting method for molding a product based on low-pressure casting by using a casting device in which a mold with a cavity is disposed over a holding furnace storing molten metal, comprising the steps of:

raising the molten metal to a vicinity of a gate of the cavity by increasing a pressure in the holding furnace and thereafter filling the cavity with the molten metal by decreasing a pressure in the cavity by suction and simultaneously further increasing pressure applied to the holding furnace to increase the pressure in the holding furnace;

stopping decompression of the cavity after a preset filling time; and stopping compression of the holding furnace when solidification of the molten metal is completed, and wherein in the step of filling the cavity with the molten metal by decreasing the pressure in the cavity by suction and simultaneously further increasing pressure applied to the holding furnace, the pressure of the holding furnace increases more rapidly than during the step of raising the molten metal to the vicinity of the gate of the cavity by increasing the pressure in the holding furnace.

2. The casting method according to claim 1, further comprising the steps of:

using a molten metal sensor for detecting completion of filling the cavity with the molten metal; and stopping decompression of the cavity when the molten metal sensor detects completion of filling with the molten metal within the preset filling time.

3. The casting method of claim 1, further comprising:

providing a plurality of casting units, each comprising a holding furnace configured to store molten metal, a mold with a cavity and a compression part configured to increase a pressure in the holding furnace; and providing a decompression part configured to decrease a pressure in the cavity of each of the plurality of casting units by suction, wherein the decompression part comprises a vacuum tank with a suction pipe at an inlet side and a discharge pipe at an outlet side, a vacuum pump connected to the discharge pipe of the vacuum tank, branch pipes that are branched from the suction pipe of the vacuum tank and are respectively communicated with the cavity of each of the plurality of casting units and on-off valves configured to open and close the respective branch pipes.

4. The casting method according to claim 3, wherein the cavity of the mold is a casting space configured for molding a suspension member of a car.

5. The casting method according to claim 3, wherein the cavity of the mold is a casting space configured for molding a cylinder head of an internal combustion engine.

6. The casting device method according to claim 3, wherein the cavity of the mold is a casting space configured for molding a motor case.

7. A casting method for molding a product based on low-pressure casting by using a casting device in which a mold with a cavity is disposed over a holding furnace storing molten metal, comprising the steps of:

raising the molten metal to a vicinity of a gate of the cavity by increasing a pressure in the holding furnace and thereafter filling the cavity with the molten metal by decreasing a pressure in the cavity by suction and simultaneously further increasing pressure applied to the holding furnace to increase the pressure in the holding furnace;

stopping decompression of the cavity after a preset filling time; and stopping compression of the holding furnace when solidification of the molten metal is completed, wherein a first rate at which the pressure in the holding furnace increases during the step of raising the molten metal to the vicinity of the gate of the cavity is slower than a second rate at which the pressure in the holding furnace increases during the step of filling the cavity with the molten metal by decreasing the pressure in the cavity by suction and simultaneously further increasing pressure applied to the holding furnace.

8. The casting method according to claim 7, further comprising the steps of:

using a molten metal sensor for detecting completion of filling the cavity with the molten metal; and stopping decompression of the cavity when the molten metal sensor detects completion of filling with the molten metal within the preset filling time.

9. The casting method of claim 7, further comprising:

providing a plurality of casting units, each comprising a holding furnace configured to store molten metal, a mold with a cavity and a compression part configured to increase a pressure in the holding furnace; and providing a decompression part configured to decrease a pressure in the cavity of each of the plurality of casting units by suction, wherein the decompression part comprises a vacuum tank with a suction pipe at an inlet side and a discharge pipe at an outlet side, a vacuum pump connected to the discharge pipe of the vacuum tank, branch pipes that are branched from the suction pipe of the vacuum tank and are respectively communicated with the cavity of each of the plurality of casting units and on-off valves configured to open and close the respective branch pipes.

* * * * *